US007463209B2

(12) United States Patent
Tang et al.

(10) Patent No.: US 7,463,209 B2
(45) Date of Patent: Dec. 9, 2008

(54) PLANAR DIPOLE ANTENNA

(75) Inventors: Chia-Lun Tang, Miao-Li Hsien (TW); Shih-Huang Yeh, Tou-Liu (TW); Kin-Lu Wong, Kao-Hsiung (TW); Yung-Tao Liu, Kao-Hsiung (TW); Ting-Chih Tseng, Tai-Nan Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 96 days.

(21) Appl. No.: 11/244,592

(22) Filed: Oct. 6, 2005

(65) Prior Publication Data

US 2006/0170605 A1 Aug. 3, 2006

(30) Foreign Application Priority Data

Feb. 3, 2005 (TW) ..... 94103392 A

(51) Int. Cl.
*H01Q 1/38* (2006.01)
*H01Q 9/28* (2006.01)

(52) U.S. Cl. ..... 343/795

(58) Field of Classification Search ..... 343/795, 343/722, 802

See application file for complete search history.

(56) References Cited

U.S. PATENT DOCUMENTS 4,860,019 A * 8/1989 Jiang et al. ..... 343/795
6,529,170 B1 * 3/2003 Nishizawa et al. ..... 343/795
6,747,605 B2 6/2004 Lebaric et al. ..... 343/795
7,102,586 B2 * 9/2006 Liang et al. ..... 343/795
2003/0020665 A1 1/2003 Shor ..... 343/810

FOREIGN PATENT DOCUMENTS

TW 529783 4/2003

* cited by examiner

*Primary Examiner*—Michael C Wimer

(57) ABSTRACT

A planar dipole antenna comprises a dielectric substrate, two radiation conductors, and a transmission line. The two radiation conductors are formed on the dielectric substrate and separated by a predefined distance. Each radiation conductor includes first and second metal plates, and a meandered metal line. The meandered metal line has two ends and at least three bending points. One end of the meandered metal line is connected to the first metal plate, while the other end is connected to the second metal plate. This antenna increases the receiver's gain up to 6.8 dBi through the use of the current distribution of three equal-phase areas. This overcomes the drawback of a conventional antenna with receiver's gain only about 2.2 dBi. This planar dipole antenna has a simple structure of single-sided circuitry, and is easily formed on the dielectric substrate by a standard printing or etching process.

10 Claims, 9 Drawing Sheets

2.5 λ dipole antenna

PLANAR DIPOLE ANTENNA

FIELD OF THE INVENTION

The present invention generally relates to a high-frequency antenna, and more specifically to a high-gain planar dipole antenna.

BACKGROUND OF THE INVENTION

With the trend of widely used wireless local area network (WLAN) applications, wireless communication products have piqued a global attention from almost all aspects. The antenna designs used for WLAN access points with high gain and omnidirectional radiation pattern have also gotten their role in development to response to the increasing demands. While providing a new antenna design with an improved functional gain, it is also required to consider the structure of the new design for a cost effective manufacturing process. The present invention thus yields a cost effective new antenna design to meet the practical need of WLAN applications.

Most existing antenna designs used for WLAN access points are either dipole or monopole as shown in FIG. 1. FIG. 1 is the structure of a traditional dipole antenna 100. This type of antenna can produce a good horizontal omnidirectional radiation pattern. Its practical use, however, has been restricted due to its complicated antenna structure and the limited receiver's gain of only 2.2 dBi. A Taiwan patent 529783, "Dipole Antenna Structure," discloses an improved dipole antenna design, which enhances the antenna operating frequency and the bandwidth stability. This design of dipole antenna, however, has no advantage of antenna gain.

In 2002, Shor (U.S. Pat. No. 6,747,605 and US publication 2003/0020665) disclosed two similar designs of planar high frequency antenna. Both designs of antenna comprise a multi-dipole structure for both signal receiving and transmission. This multi-dipole antenna also comprises multiple sets of opposing layered conducting strips formed on the two sides of a substrate. In addition to the fact that it is a more complex design to distribute the whole antenna over a two-sided printed circuit board, this type of antenna also needs added chips for inductor or capacitor to achieve broader bandwidth and the compatible matching. The operating bandwidth of this type of antenna is between 5.15-5.35 GHz; its antenna gain is around 4.5 dBi; the antenna dimension is around 1.2 wavelengths (λ). To get higher gain of 7 dBi, the antenna dimension needs to be extended to 2.6 wave length (λ), which is too bulky for practical applications.

To overcome the drawback of the conventional antenna design with a complex structure and a limited gain of 2.2 dBi, the present invention provides a planar dipole antenna, which has three equal-phase current areas, with much higher gain of 6.8 dBi. The present invention is a single-sided circuitry design, which is a simple structure and can be easily formed on the dielectric substrate by a standard printing or etching process.

SUMMARY OF THE INVENTION

The present invention can resolve the drawback of the conventional planar dipole antenna with too low of antenna gain. The present invention provides an improved design of a planar dipole antenna with much higher gain and the feature of omnidirectional radiation pattern. While having much higher antenna gain, this new design of planar dipole antenna has a simple structure, and can be easily manufactured. The invention also qualifies itself as a cost effective antenna design. Compared with the conventional planar dipole antenna designs with complex structure, high manufacturing cost, and limited antenna gain, the present invention has advantages of simple structure, easily being manufactured and having much higher gain in performance.

The planar dipole antenna according to the present invention mainly comprises a dielectric substrate, two radiation conductors and a transmission line. The two radiation conductors are separated by a predefined distance, and formed on the dielectric substrate. Each radiation conductor comprises a first metal plate, a second metal plate and a meandered metal line. The first metal plate has a feeding point thereon. The meandered metal line has two ends connected to the two metal plates, respectively. The transmission line comprises a signal conductor and a grounding conductor. The signal conductor connects the feeding point of one radiation conductor, while the grounding conductor connects to the other feeding point of the second radiation conductor.

From the experimental result of the present invention, the first embodiment of the present invention is a good candidate for WLAN applications with the operating bandwidth requirement within 2.4 GHz (2400-2484 MHz). The high gain and the omnidirectional radiation pattern which the present invention provides qualify itself for being used as an access point antenna.

According to the present invention, the length of the first metal plate and the second metal plate on the two radiation conductors is adjusted to approximate the ¼ wavelength and the ½ wavelength of the antenna's operating frequency, respectively. The meandered metal line, due to the coupling effect from the metal plates, also has the equivalent effect of ½ wavelength of the antenna's operating frequency. The currents on the two metal plates are in the same direction, while the current in the meandered metal line is in different direction. Although the current on the meandered metal line is in opposite direction, the convoluted shape of the meandered metal line, however, can efficiently suppress its negative effect over the antenna's overall omnidirectional radiation pattern. With this design, the two metal plates on the two radiation conductors constitute three equal-phased current distributions. The final composite effect of radiation results in the enhanced antenna gain up to 6.8 dBi.

With the present invention, there is no need for extra complex antenna feeding circuits or added chips for conductors or capacitors to achieve broader bandwidth and the compatible matching. With the same gain level of 6.8 dBi, the antenna dimension of the present invention is 1.7λ, which is much smaller than the 2.4λ of a conventional antenna design. The present invention also advantages itself as a cost effective antenna design, which has high gain but has simple structure of single-sided circuitry for easily manufacturing.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
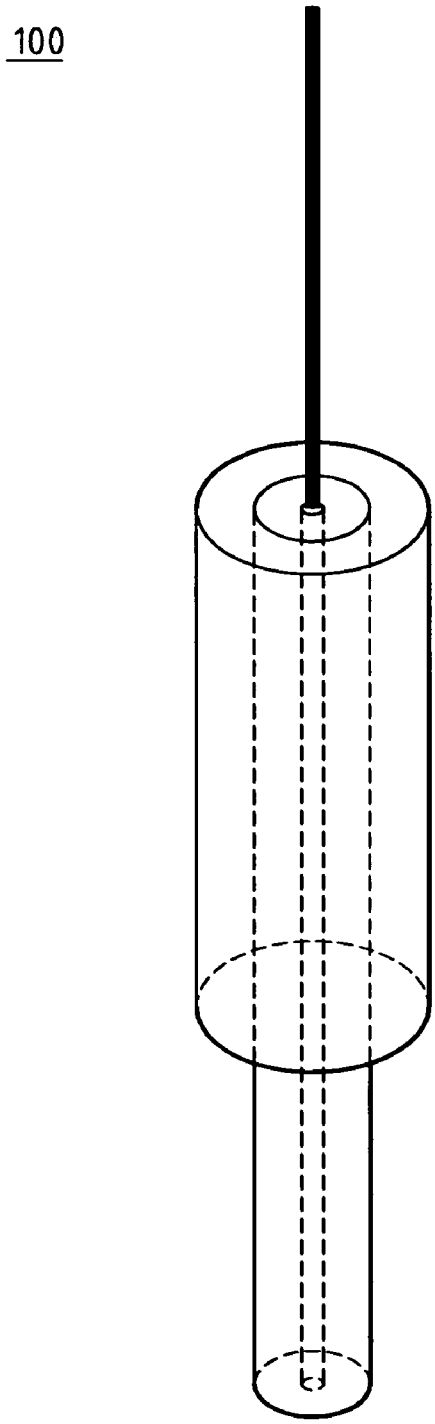
FIG. 1 (PRIOR ART)
FIG. 1 shows a structural view of a traditional dipole antenna.
Figure 2A:
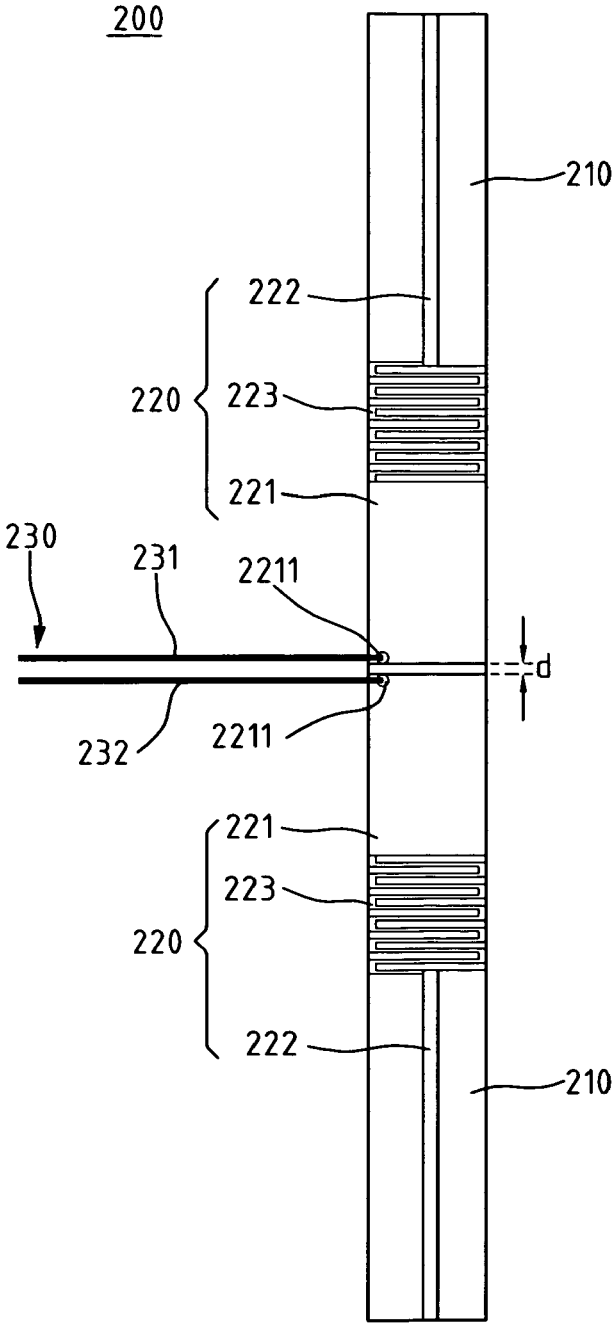
FIG. 2A shows a structural view of the present invention of a planar dipole antenna.
Figure 2B:
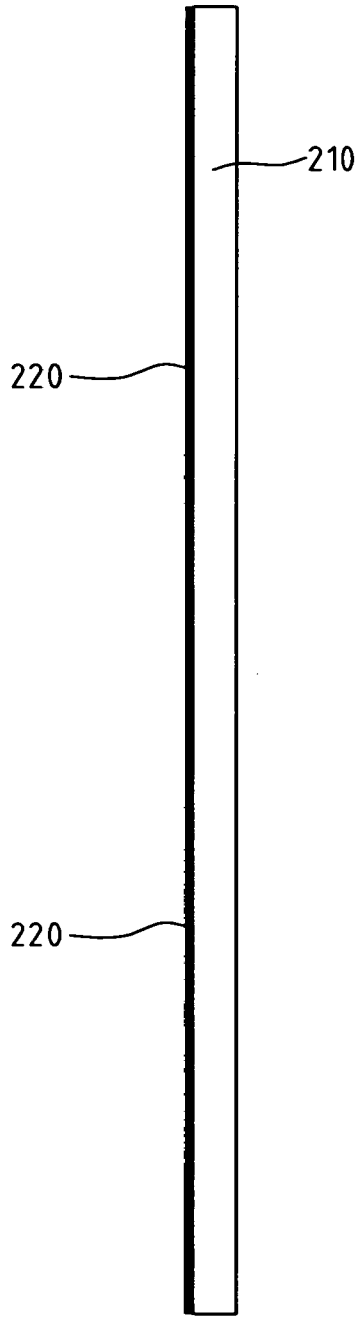
FIG. 2B shows a structural side view of the present invention of a planar dipole antenna.

FIGS. 2A, 2B illustrate a structural view and a side view of the planar dipole antenna according to the present invention. Referring to FIG. 2A, the planar dipole antenna 200 comprises a dielectric substrate 210, radiation conductors 220, and a transmission line 230. The two radiation conductors 220 are separated by a predefined distance d, and formed on the dielectric substrate 210. Each radiation conductor 220 comprises a first metal plate 221, a second metal plate 222, and a meandered metal line 223. The first metal plate 221 has a feeding point 2211. The meandered metal line 223 has two ends connecting to the first metal plate 221 and the second metal plate 222, respectively. As can be seen from FIGS. 2A and 2B, the two radiation conductors 220 are substantially identical and symmetric. The transmission line 230 comprises a signal conductor 231 and a grounding conductor 232, which are connecting to the two feeding points 2211 of the two radiation conductors respectively. The two first metal plates 221 on the two radiation conductors 220 are adjacent to each other by a predefined distance d. The transmission line 230 may be a coaxial line or a microstrip line.

Figure 3A:
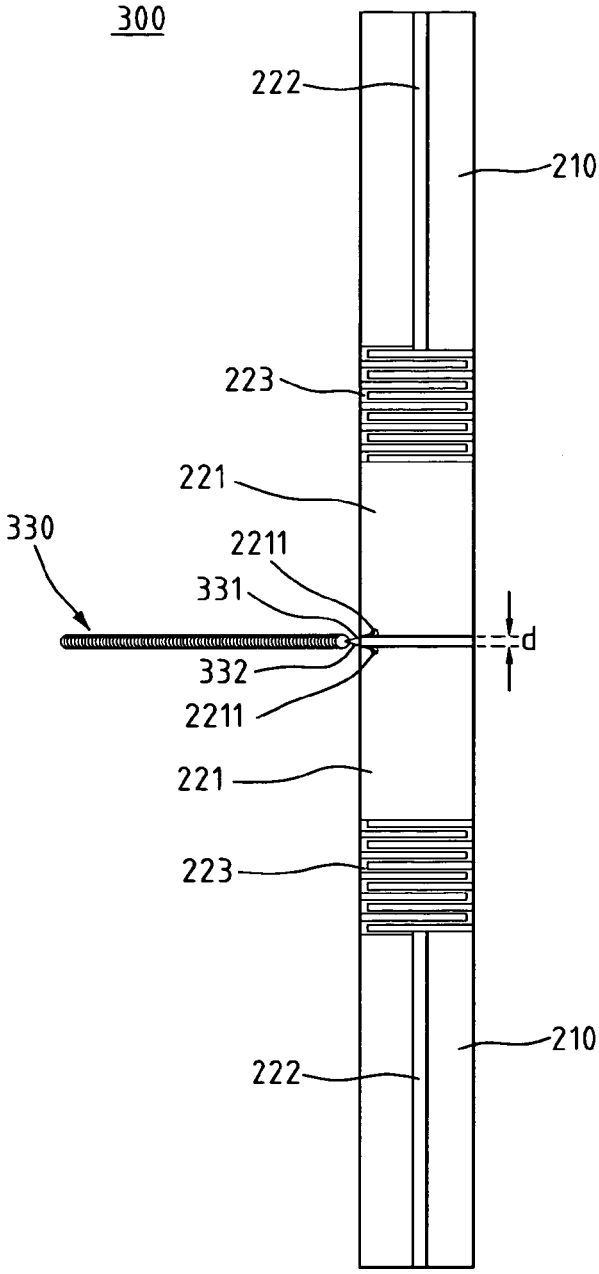
FIG. 3A shows a structural view of the first embodiment of the present invention.
Figure 3B:
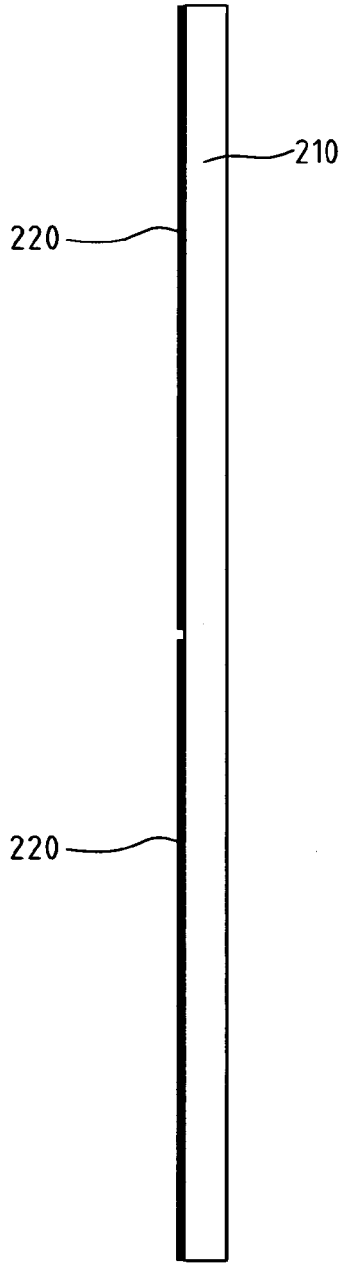
FIG. 3B shows a structural side view of the first embodiment of the present invention.

FIGS. 3A and 3B illustrate a structural view and a side view of a first embodiment of the present invention. The transmission line used for the first embodiment is a coaxial line. Planar dipole antenna 300 comprises a dielectric substrate 210, two radiation conductors 220 and one coaxial transmission line 330. The coaxial transmission line 330 comprises a center conductor 331 and an outer grounding conductor 332. The shape of the first metal plate 221 approximates a rectangle with the length approximating the ½ wavelength (λ) of the center operating frequency of the antenna 300. The length of the second mental pate 222 approximates the ½ wavelength (λ) of the center operating frequency of the antenna 300. The meandered metal line has at least three bending points. The center conductor 331 and the outer grounding conductor 332 of the coaxial transmission line 330 are connecting to the two feeding points 2211 of the two radiation conductors 220. The adjacent distance between the two radiation conductors 220 is a predefined value d of less than 4 mm. The two radiation conductors 220 are formed by a standard printing or etching process on a dielectric substrate 210. The width of the second metal plates 222 on the two radiation conductors 220 is also a fixed value.

Figure 4:
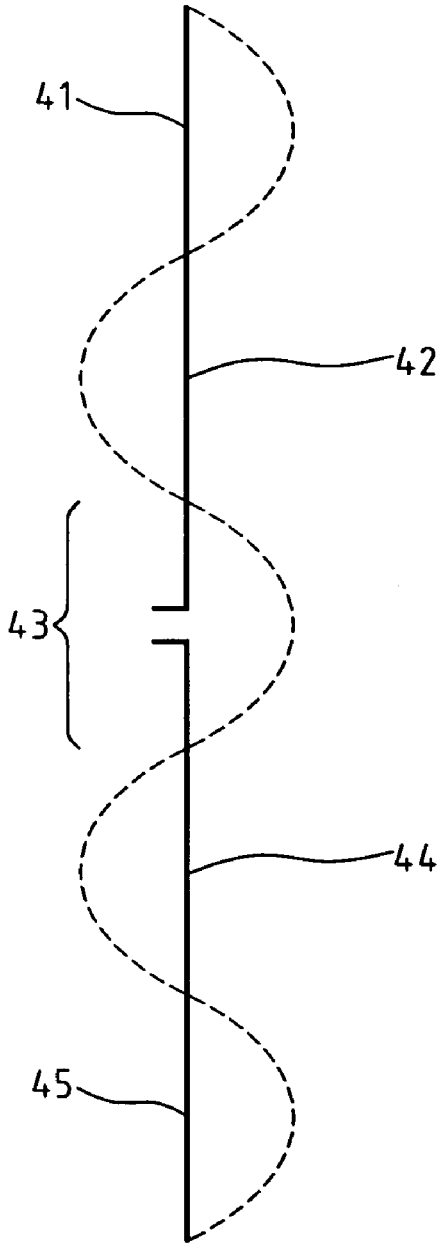
FIG. 4 shows the current distribution of a conventional 2.5λ dipole antenna.

FIG. 4 is the current distribution of a conventional planar antenna with the length of 2.5λ wherein, 41, 42, 43, 44, 45 are the equal-phase intervals of the conventional 2.5λ planar antenna. The dashed line represents the current magnitude. Comparing FIG. 4 with FIG. 3, which illustrates the first embodiment of the present invention, interval 41 can represent the second metal plate 222 of the upper radiation conductor 220; 42 can represent the meandered metal line 223 of the upper radiation conductor 220; 43 can represent the first metal plate 221 of the upper radiation conductor 220 as well as the first metal plate 221 of the lower radiation conductor 220; 44 can represent the meandered metal line 223 of the lower radiation conductor 220; 45 can represent the second metal plate 222 of the lower radiation conductor 220. The present invention can generate three equal-phased currents (41, 43, and 45). Although the current generated from the two meandered metal lines (intervals 42 and 44) are in opposite direction, the convoluted shape of the two meandered metal lines 223 can efficiently suppress their negative effect on the antenna's overall omnidirectional radiation pattern, and this effectively promotes the overall antenna gain.

Figure 5:
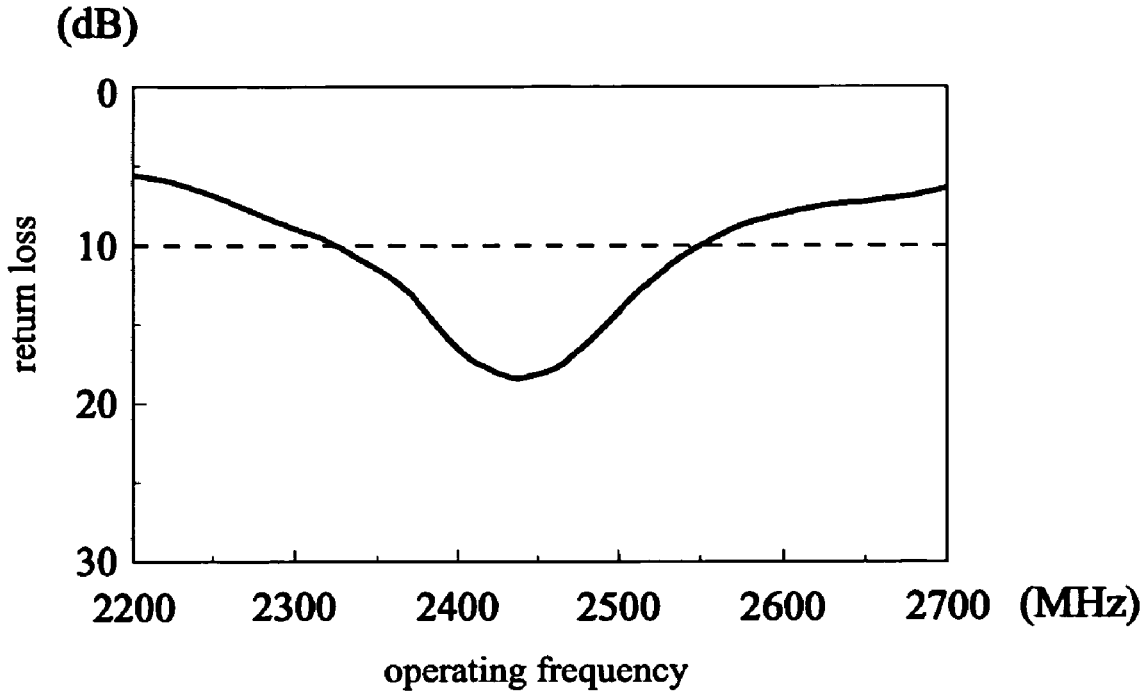
FIG. 5 shows the measured result of the return loss of the first embodiment of the present invention.

FIG. 5 shows the measured return loss of the first embodiment with the present invention. The result was evaluated out of the following measurements: the first metal plate 221 approximates 28 mm in length and 10 mm in width. The second metal pate 222 approximates 56 mm in length and 1 mm in width. The meandered metal line 223 has 11 banding points. The highly convoluted meandered metal line 223 greatly reduces the gap it needs on the radiation conductor 220 by about 16 mm. The compact meandered metal line also condenses the width of the whole antenna to 10 mm. With less number of bending points on the meandered metal line, the overall antenna width increases accordingly. The gap between the upper and the lower radiation conductors 220 is about 2 mm. This results in a good impedance matching and bandwidth. The dielectric substrate 210 is made of an FR4 substrate with dielectric index of 4.4. Referring to FIG. 5, the vertical axial represents the return loss in dB, while the horizontal axial represents the operating frequencies. The result of the experiment shows that, whenever the return loss is greater than 10 dB, the bandwidth of the operating frequencies can well cover the 2.4 GHz (2400-2484 MHz) range for WLAN applications.

Figure 6:
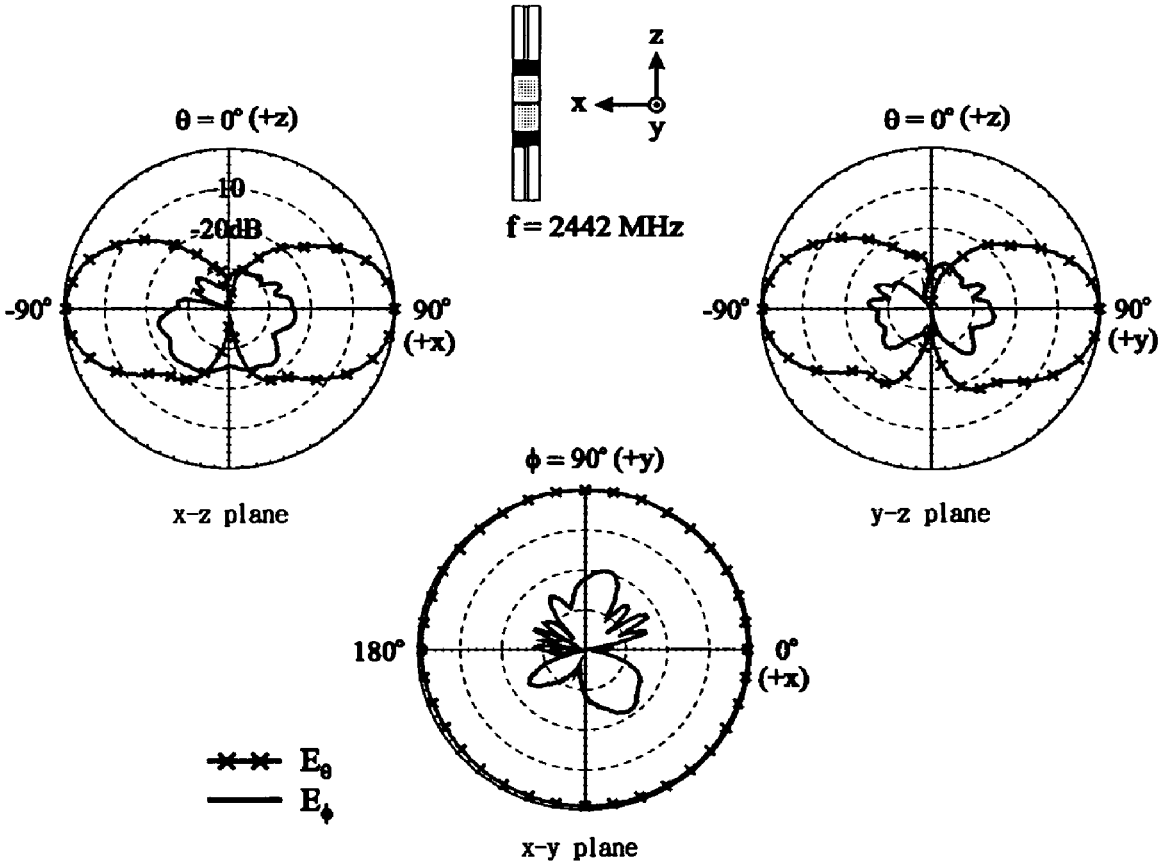
FIG. 6 shows the measured result of the antenna radiation pattern when the first embodiment of the present invention is operated at 2442 MHz.

FIG. 6 illustrates the measured radiation pattern, operating at 2442 MHz, of the first embodiment of the present invention. From the result, the antenna demonstrates a good omnidirectional radiation pattern on the x-y plane. With the high gain of 6.8 dBi, this antenna design satisfies the general operating requirement for 2.4 GHz WLAN applications.

Figure 7:
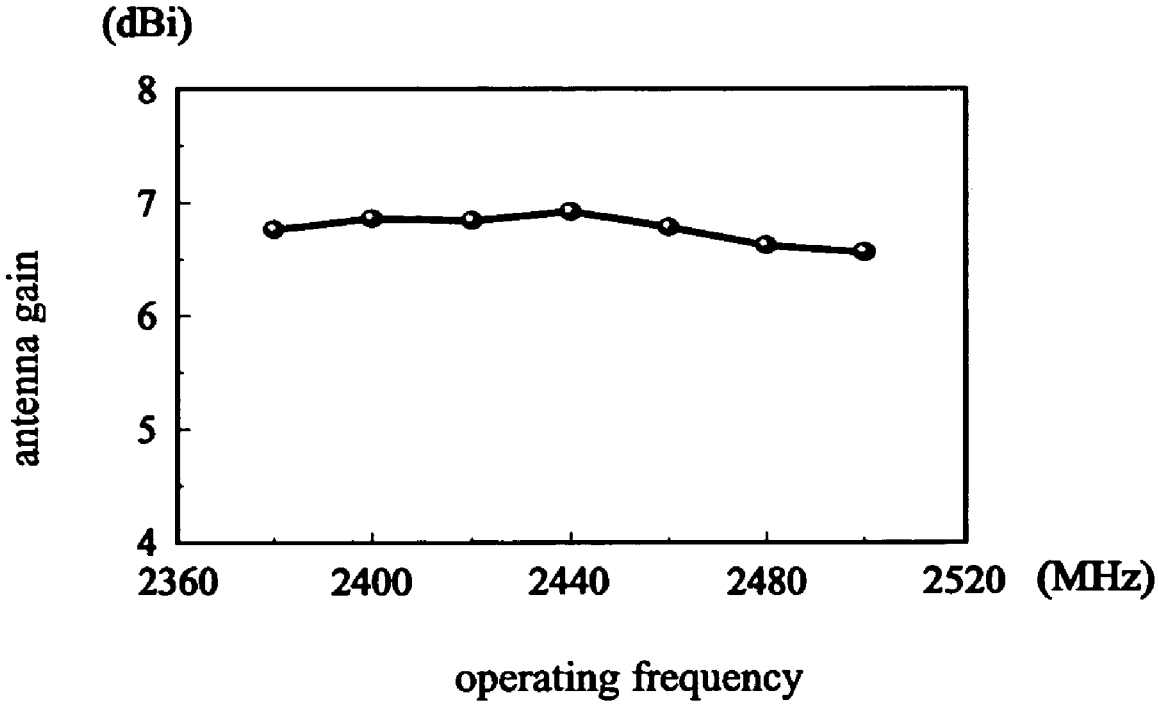
FIG. 7 shows the measured result of the antenna gain when the first embodiment of the present invention is operated in 2.4 GHz band.

FIG. 7 illustrates the measured result of the antenna gain of a first embodiment of the present invention, which is operating within the 2.4 GHz band. Referring to FIG. 7, the vertical axial represents the antenna gain; the horizontal axial represents the operating frequencies. From the measured result, the antenna gain remains in 6.6-6.8 dBi within the frequency range of the operating modeling. This demonstrates that the antenna design with the present invention satisfies the general high gain requirement for 2.4 GHz WLAN applications.

Figure 8:
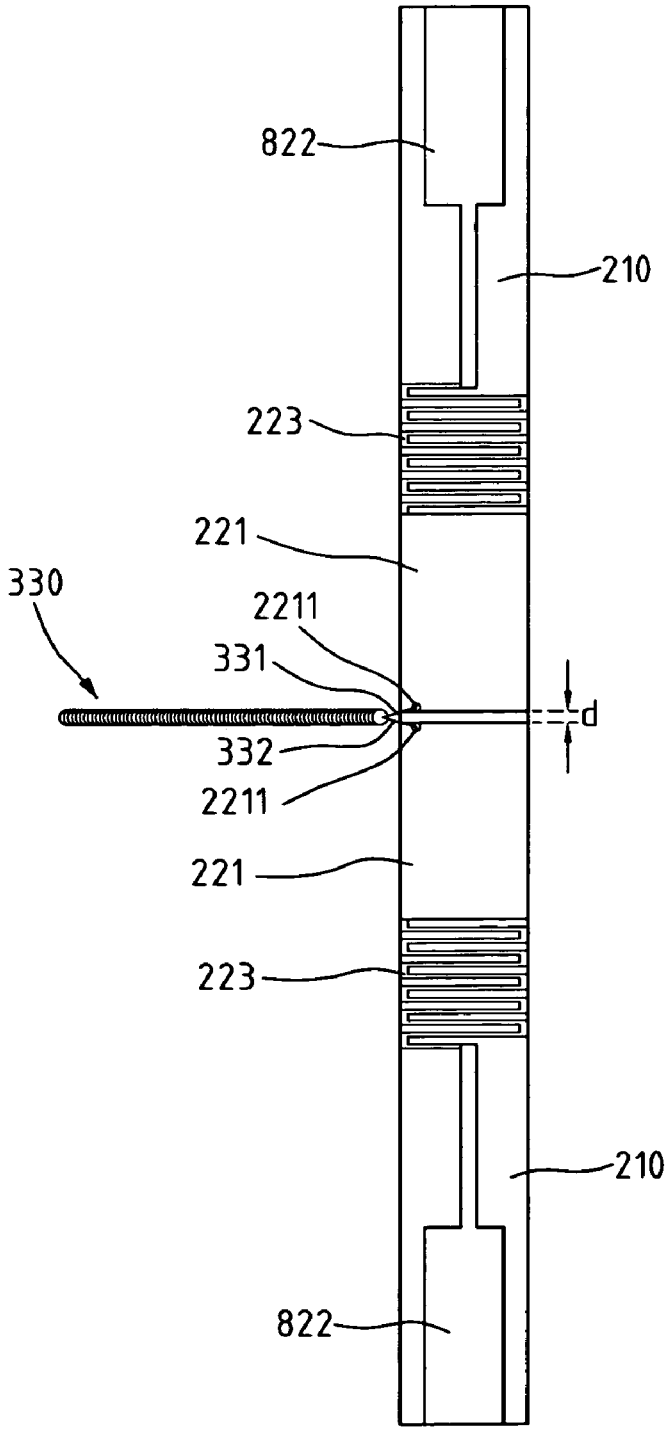
FIG. 8 shows a structural view of the second embodiment of the present invention.
Figure 9:
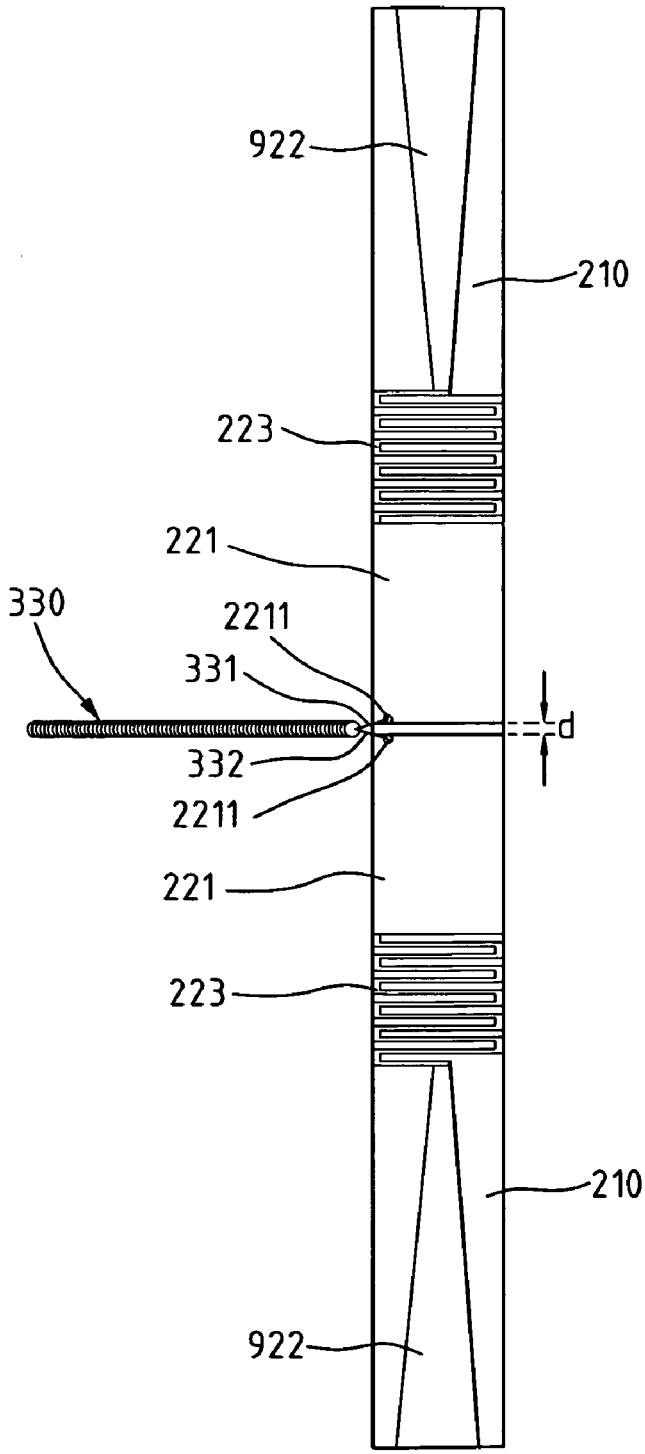
FIG. 9 shows a structural view of the third embodiment of the present invention.

FIG. 8 and FIG. 9 illustrate the structural views of a second embodiment and a third embodiment of the present invention, respectively. The second and the third embodiments are similar to the first embodiment, except for the variations of the shape of the second metal plate on each radiation conductor. The shape of the second metal plate 822 of the second embodiment has a single stepping type of variation for its width. The shape of the second metal plate 922 of the third embodiment has a linear progressive type of variation for its width. The second metal plate 822 in the second embodiment and the second metal plate 922 in the third embodiment all have the same effect as in the first embodiment.

According to the present invention, by adjusting the length of the first metal plate and the second metal plate on the two radiation conductors to approximate the ¼ wavelength and ½ wavelength of the antenna's operating frequency, the meandered metal line, due to the coupling effect from the metal plates, has the equivalent effect of ½ wavelength of the antenna's operating frequency. The currents on the two metal plates are in one direction, while the current in the meandered metal line is in opposite direction. Although the current on the meandered metal line is in reversed direction, the convoluted shape of the meandered metal line, however, efficiently suppresses its negative effect on the whole antenna's overall omnidirectional radiation pattern. With this coupling design, the two metal plates on the two radiation conductors constitute three equal-phased current distributions. The final composite effect of radiation results in a much enhanced antenna gain up to 6.8 dBi.

In additions, the central operating frequency of an antenna with the present invention can be changed by adjusting the length of the first metal plate on each radiation conductor and the length of the meandered metal line. The good impedance matching and impedance bandwidth of the antenna in accordance with the present invention can be achieved by adjusting the width of the first metal plate and the predefined gap between the two radiation conductors. With aforementioned features, a high gain antenna for WLAN applications with 2.4 GHz operating bandwidth can be easily designed.

The present invention does not need added complex feeding circuits or extra chips for conductors or capacitors for broader bandwidth and its compatible matching. With the same receiver's gain of 6.8 dBi, the antenna according to the present invention is 1.7λ, which is much smaller than a conventional 2.4λ antenna. Due to the simple structure of the single-sided circuitry for easy manufacturing, the present invention also advantages itself as a cost effective antenna design for a high gain product.

In conclusion, the antenna according to the present invention has advantages of being simple structured, involving low manufacturing cost, and having precise functionality. The antenna has high potential for commercialized applications, which thus qualifies itself as an invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A planar dipole antenna with a single operating frequency, comprising:

a dielectric substrate;

two radiation conductors separated by a predefined distance and formed on said dielectric substrate, each radiation conductor further comprising a first metal plate having a signal feeding point, a second metal plate and a meandered metal line connecting said first metal plate and said second metal plate, respectively; and a transmission line having a signal conductor and a grounding conductor being connected to said signal feeding point of one radiation conductor and said signal feeding point of the other radiation conductor;

wherein the two first metal plates on the two radiation conductors are adjacent to each other by a predefined distance and said meandered metal line has an equivalent length approximately ½ wavelength of the operating frequency of said planar dipole antenna.

2. The planar dipole antenna as claimed in claim 1, wherein the length of said first metal plate on each radiation conductor approximates ¼ wavelength of the operational frequency of said planar dipole antenna.

3. The planar dipole antenna as claimed in claim 1, wherein the length of said second metal plate on each radiation conductor approximates ½ wavelength of the operational frequency of said planar dipole antenna.

4. The planar dipole antenna as claimed in claim 1, wherein the shape of said first metal plate on each radiation conductor approximates a rectangle.

5. The planar dipole antenna as claimed in claim 1, wherein said predefined distance between the two radiation conductors is less than 4 mm.

6. The planar dipole antenna as claimed in claim 1, wherein the width of said second metal plate on each radiation conductor is a constant.

7. The planar dipole antenna as claimed in claim 1, wherein the width of said second metal plate on each radiation conductor varies in a single stepping manner.

8. The planar dipole antenna as claimed in claim 1, wherein the width of said second metal plate on each radiation conductor varies in a liner progressive manner.

9. The planar dipole antenna as claimed in claim 1, wherein said transmission line is either a coaxial transmission line or a micro strip transmission line.

10. The planar dipole antenna as claimed in claim 1, wherein said meandered metal line has at least three bending points.

* * * * *